US005203043A

United States Patent [19]

Riedel

[11] Patent Number: 5,203,043

[45] Date of Patent: Apr. 20, 1993

[54] METHOD FOR CONTINUOUSLY INTENSIVELY WETTING A FLAT ARTICLE, ESPECIALLY A TEXTILE STRIP

[75] Inventor: Dieter Riedel, Porta Westfalica, Fed. Rep. of Germany

[73] Assignee: Johannes Menschner Maschinenfabrik GmbH & Co. KG, Viersen, Fed. Rep. of Germany

[21] Appl. No.: 755,434

[22] Filed: Sep. 5, 1991

[30] Foreign Application Priority Data

Oct. 2, 1990 [DE] Fed. Rep. of Germany ..... 4031063

[51] Int. Cl.[5] ..... D06B 5/08

[52] U.S. Cl. ..... 8/149.1; 8/151; 68/5 D; 68/45; 68/158; 68/903

[58] Field of Search ..... 8/149.1, 151; 68/903, 68/5 D, 45, 158, 44, 62, 205 R

[56] References Cited

U.S. PATENT DOCUMENTS

| | | | |
|---|---|---|---|
| 1,432,319 | 10/1922 | Brandwood et al. | 68/903 X |
| 2,080,635 | 5/1937 | Schramek et al. | 68/205 R |
| 2,817,227 | 12/1957 | Eriksson | 68/44 X |
| 3,270,532 | 9/1966 | Chaikin et al. | 68/903 X |
| 3,410,119 | 11/1968 | Fleissner | 68/903 X |
| 3,499,176 | 3/1970 | Bahnsen | 8/149.1 |
| 3,779,047 | 12/1973 | Fleissner | 68/903 X |
| 4,324,116 | 4/1982 | Davis | 68/62 X |

FOREIGN PATENT DOCUMENTS

| | | | |
|---|---|---|---|
| 642495 | 1/1964 | Belgium | 68/903 |
| 2121722 | 11/1972 | Fed. Rep. of Germany | 68/45 |
| 2139710 | 2/1973 | Fed. Rep. of Germany | 68/903 |
| 2738998 | 3/1976 | Fed. Rep. of Germany | 68/903 |

*Primary Examiner*—Philip R. Coe
*Attorney, Agent, or Firm*—Michael J. Striker

[57] ABSTRACT

The process for continuous intensive wetting of a textile strip with a wetting fluid, e.g., water, includes providing an outer surface of a permeable drum (1) with a permeable accompanying member (2) contacting the outer surface; pressing a textile strip (3) against the accompanying member (2) with a permeable press belt (4); tensioning the permeable press belt on the textile strip; to exert a pressing force on the textile strip; controlling the tension in the accompanying member (4) exerting the pressing force on the textile strip (3) to prevent the textile strip from swelling during wetting; dipping the permeable drum (1) together with the accompanying member (2), the press belt (4) and the textile strip (3) only partially into a container holding water to load the accompanying member (2) and the permeable press belt with the water; and subjecting the textile strip (3), the accompanying member (2) and the permeable press belt (4) to a suction pressure in a suction treatment to draw moisture and air through them.

7 Claims, 1 Drawing Sheet

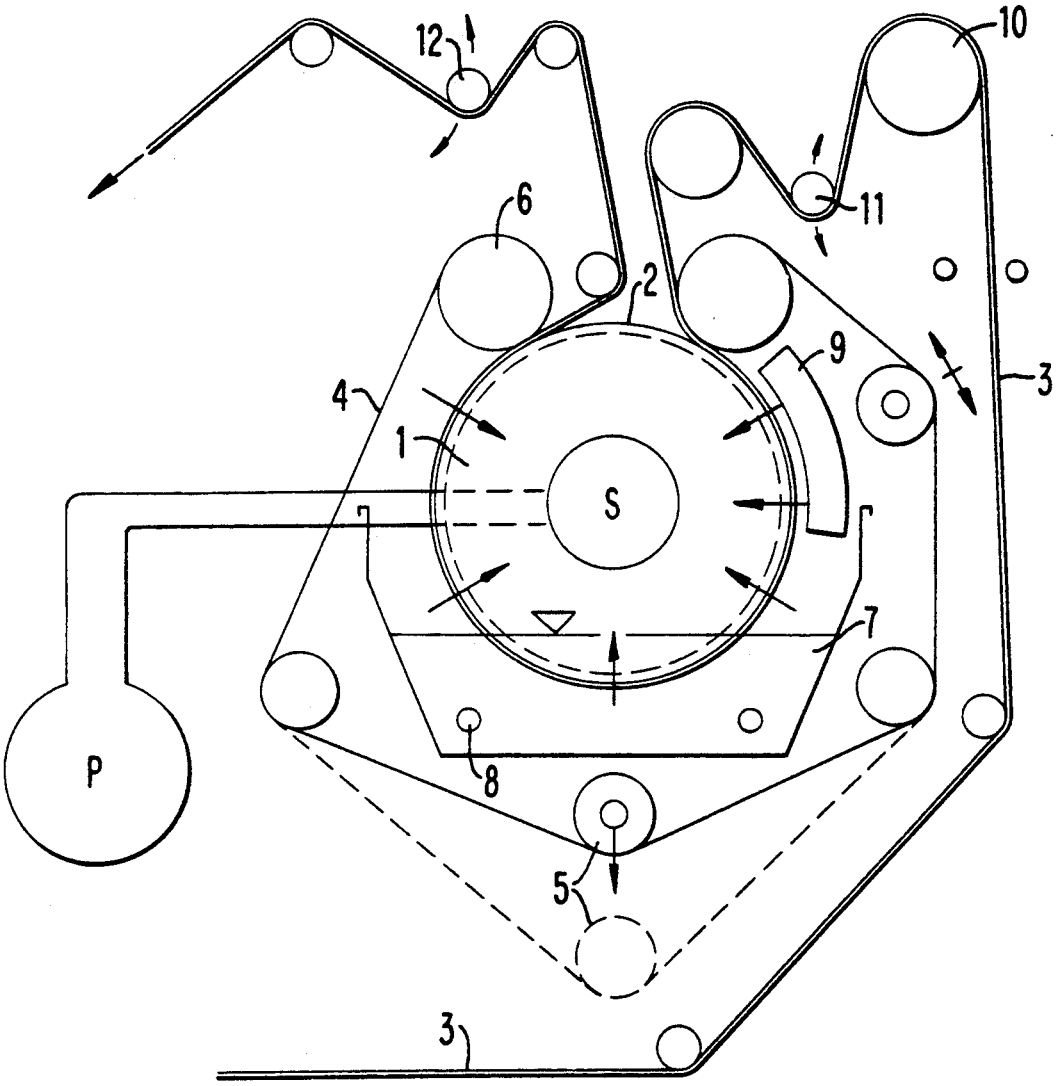
12
10
6
11
2
9
3
4
1
S
7
P
8
5
3

METHOD FOR CONTINUOUSLY INTENSIVELY WETTING A FLAT ARTICLE, ESPECIALLY A TEXTILE STRIP

BACKGROUND OF THE INVENTION

The invention relates to a method and apparatus for continuously intensively wetting a flat article, especially a textile strip and the like.

In the working of wool goods and the like, the moistening or wetting of the filaments or fiber plays a decisive roll. English cloth, for example, owes its world wide reputation substantially to the fact that the water bound to the wool fibers is somewhat greater in quantity than in the best cloth of German and/or Italian origin. The reason for this is that the English climate has an excessive amount of moisture. However, by further economizing and increasing production output the time for manufacture is still less, because the usual pauses for climatizing the wool can be omitted. The long known "synthetic relaxation periods", e.g. by wetting steps, are only partially successful. The wetting methods known up to now fulfill the desired requirements only incompletely, because the atomization of the water is not fine enough, i.e. leads to droplets which are too large, so that only the material upper surfaces are wet, but not the interior of the wool material, particularly fibers in its central portion or core.

The wetting devices on the market currently operate according to different methods, e.g.:

1. Spraying of water by nozzles or rotors:

The moisture increase obtainable in that in the material is limited to about 8 to 12%. With larger amounts (often over 5%), an uneven effect often results. At those locations, where the water jet has impinged, strips are formed on the goods. Additional problems arise because of calcium salt deposition in the nozzles or rotors.

2. Aeration Units:

These units, e.g. mist generators or the like, provide a comparatively good uniformity over the entire goods width, when suitable machines with uniform suction capabilities are used, which draw the provided moisture through the goods. The obtainable effective moisturizing value are however comparatively low.

3. Devices for Wetting the Goods by Application of a Liquid Film.

These devices also have only limited applicability for wool or wool mixed textiles, because again inhomogeneities arise in pads, because of breakdown of the liquid film (formation of flecks, drops, schlieren and the like).

The correct and above all uniform wetting of wool goods and the like is however entirely important, indeed even decisive for the fixing process, especially to obtain a permanent fixing in wet (Flat-Setting Hydrosurface fixing) and in the dry state (permanent decatizing). In the hydrosurface fixing performed presently, one works the fixing material in the wet state, i.e. after the squeeze out process of the pad or the like at a residual moisture content of about 50 to 70%, according to the qualities of the pad or the like.

These known methods have a high cost, because much energy is necessary for drying, to bring the wet goods after fixing again to a normal moisture content. Scientific tests one year ago have however already shown that one obtains the best fixing values, e.g. with wool goods, between 25 to 35% moisture. Such values have not been obtained up to now in practice.

With total wetting or immersion in water in a water bath and subsequent squeezing out methods a limiting content of about 50% moisture can be obtained. On the other hand the moisture of the dried goods amounts to a maximum of from 10 to 12%, whereby these values must only be momentary results. The moisture has not gone deeply into the material and is easily returned to the environment by evaporation—unfortunately in a nonuniform manner. The result is a nonuniform wetting effect leading to an equivalently nonuniform fixing effect.

A strip free and intensively operating wetting apparatus, which operates continuously with a speed of at least 16 to 25 m/min goods transport speed and meets the desired requirements has not been available up to now.

SUMMARY OF THE INVENTION

It is an object of the present invention to provide a process by which a continuous strip-free intensive wetting of the material to be treated, e.g. textiles, is performed at high speed.

It is also an object of the present invention to provide an apparatus for performing this process.

According to the present invention, the process for continuous intensive wetting of a permeable flat article, particularly a textile strip, comprises wetting the flat article with a wetting liquid, predominantly water, by two continuously running permeable accompanying members contacting both sides of the flat article and loaded with the wetting liquid. One accompanying member exerts a pressing force on the flat article by being placed under tension to press the flat article. The flat article and both of the accompanying members are subjected to a suction pressure in a suction treatment.

Advantageously the process of wetting the flat article also includes impinging a hot gaseous medium, preferably steam or hot air, on the accompanying member exerting the pressing force on the flat article.

The apparatus for continuous intensive wetting of a permeable flat article, particularly a textile strip, comprises a source of suction pressure for the suction treatment and a cylindrical rotatable drum connectable to the source of the suction pressure, the cylindrical rotatable drum having a perforated peripheral surface against which the accompanying member not exerting the pressing force rests, and the other accompanying member exerting the pressing force is an endless press belt, a major portion of the endless press belt being slung around the drum contacting the flat article which passes over the accompanying member not exerting the pressing force.

The apparatus also includes a plurality of guide rollers around which the other accompanying member acting as the endless press belt is guided, at least one of the guide rollers being adjustable for changing the pressing force and one other of the guide rollers being a drive roller for the other accompanying member.

The apparatus also includes a container for a wetting liquid and a heating device in the container located so as to be able to control the temperature of the wetting liquid contained in the container. The container is positioned to receive the drum, so that the flat article and the accompanying members slung around the drum is contacted by the wetting liquid.

Advantageously a compensating device, through which the flat article is guided, is provided. This compensating device is structured to control the speed of the drive roller. Another compensating device can be located downstream of the drum for further synchronized control of the flat article leaving the drum for further processing.

With the features of the invention the desired moisture content of the goods of up to 35% can be obtained without stripe formation. Moreover, the degree of wetting can be made independent of the goods conveying speed and also of other parameters, e.g. the temperature of the water bath, the level of the water in the container (immersion depth of the drum), of the capacity of the vacuum pump and of the moisture content.

An additional advantage is that by wetting under pressure less finishing effects are lost in the goods than in the case of wetting without pressure. The goods under pressure are transformed from the base material less than in wetting without pressure, because fiber swelling and volume increase are prevented. The supplied moisture content is pressed into the core of the goods.

BRIEF DESCRIPTION OF THE DRAWING

The objects, features and advantages of the present invention will now be illustrated in more detail by the following detailed description, reference being made to the accompanying drawing in which:

The sole figure is a schematic cross-sectional view through an apparatus for performing the method of the invention.

DETAILED DESCRIPTION OF THE PREFERRED EMBODIMENT

The apparatus according to the invention shown in the figure comprises a cylindrical rotatably mounted drum 1, whose outer peripheral surface is perforated. The drum 1 is connected by a suction duct S to an air fan or vacuum pump P, e.g. an exhaust fan or the like. A permeable accompanying member 2 rotating with the drum 1 rests on the outer surface of the drum 1. This permeable accompanying member 2 in this embodiment is a permeable jacket or sleeve. The invention is however in no way limited to this special embodiment. The accompanying member 2 can be constructed as an endless accompanying member as it is in the case of this embodiment and can be fed over a plurality of guide rollers.

A textile strip 3 is pressed against the accompanying member 2 by another permeable accompanying member 4, which may be an endless press belt. Thus the drum 1 and the textile strip 3 are connected, so that they move together with the other accompanying member 4. The pressing action is provided by a controllable guide roller 5. One of the guide rollers, namely 6, is also the drive roller from the other accompanying member 4, i.e. the press belt.

The material of the textile strip 3 cannot swell, because of the pressure exerted by the other accompanying member 4 which presses the textile strip 3, so that the moisture can be forced into the core of the goods.

As a result of the continuous evacuation of the drum 1, the textile strip 3 and both the accompanying member 2 and the other clamped accompanying member 4, which are slung around the major portion of the circumference of the drum 1, are subjected to the suction treatment because moisture and air are drawn through them and the perforations in the drum and into the suction duct S.

As the drawing clearly indicates, the drum 1 with the textile strip 3 and both accompanying member 2 and the other accompanying member 4 dip into a container 7 filled with a wetting liquid, e.g. water, in which a heating device 8 is located. The level in the container 7 and the temperature of the heating device 8 are appropriately regulatable. By the rotary motion of the drum 1 in the heated water bath a continual wetting of both accompanying member 2 and accompanying member 4, and thus necessarily of the textile strip 3, occurs. The wetting of the accompanying member 4 from the outside and that of the accompanying member 2 from the interior of the drum 1 (wick system).

The clamped accompanying member 4 pressing the textile strip 3 is acted on with a hot gaseous medium, e.g. steam or hot air. This occurs by action of one or more steam chambers 9, which expel saturated steam or hot air, which is drawn by the low pressure through the accompanying member 4 and the accompanying member 2 and the textile strip 3 into the drum 1. The textile strip 3 produced already by the steam and the low pressure already has a good moisture content, which is increased in due course by drawing of the hot moisture through it. In this way the textile strip 3 is hygroscopic.

In simplified form, it is conceivable that instead of the perforated drum 1 a closed and interiorly heated drum is used, because the textile strip 3 is hygroscopic because of the heat transferred and the needed moisture is received more quickly from the accompanying member 2 and the other accompanying member 4. The advantage of the perforated drum is that the receiving capacity can be additional increased, because of the more or less quantities drawn through it.

The wetting apparatus may be easily combined with subsequent processing machines. Thus the drive roller 10 provides that the textile strip to be moistened is conveyed without being pulled by the wetting device. A compensating device 11 connected downstream of this drive roller 10 automatically controls the drive speed of the roller 10, so that it remains constant and no goods pulling arises.

Another compensating device 12 connected downstream of the liquid container and drum provides synchronous regulation of the textile sheet in the subsequent processing devices.

It is also conceivable to apply chemicals to the goods, which are dissolved in water. In this case the chemicals are added to the solution in the reservoir.

While the invention has been illustrated and described as embodied in a method and apparatus for continuously intensively wetting a flat article, especially a textile strip, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. Process for continuous intensive wetting of a permeable flat article, comprising the steps of:

a) wetting a flat permeable article (3) with a wetting liquid by contacting two continuously running permeable accompanying members (2,4) on both sides of the permeable flat article (3), said two continuously running permeable accompanying members being loaded with the wetting liquid;

b) tensioning one of the accompanying members (4) contacting on the permeable flat article (3) to provide a tension in the accompanying member (4) and to exert a pressing force on the permeable flat article (3);

c) controlling the tension in the accompanying member (4) exerting the pressing force on the permeable flat article (3) to prevent the flat article from swelling; and d) subjecting the permeable flat article (3) and both of the accompanying members (2,4) to a suction pressure in a suction treatment to draw moisture and air through the flat article (3) and both of the accompanying members (2,4).

2. Process according to claim 1, further comprising impinging hot steam on the accompanying member (4) exerting the pressing force on the permeable flat article (3) to further moisturize the flat article.

3. Process according to claim 1, further comprising changing the suction pressure to control the suction treatment.

4. Process according to claim 1, further comprising dipping both the accompanying members and the permeable flat article into a source of the wetting liquid and controlling a temperature of the wetting liquid.

5. Process for continuous intensive wetting of a textile strip with a wetting fluid, comprising the steps of:

a) providing an outer surface of a permeable drum (1) with a permeable accompanying member (2) contacting the outer surface;

b) pressing a textile strip against the permeable accompanying member (2) with a permeable press belt;

c) moving the textile strip together with the permeable accompanying member (2) and the permeable press belt around the permeable drum;

d) tensioning the permeable press belt on the textile strip to exert a pressing force on the textile strip and to provide a tension in the permeable press belt;

e) controlling the tension in the permeable press belt exerting the pressing force on the textile strip so as to prevent the textile strip from swelling;

f) dipping the permeable drum (1) together with the accompanying member (2), the press belt and the textile strip only partially in a wetting liquid to load the accompanying member (2) and the permeable press belt with the wetting liquid; and g) subjecting the textile strip, the accompanying member (2) and the permeable press belt to a suction pressure in a suction treatment to draw the wetting liquid through the textile strip, the permeable press belt and the accompanying members (2).

6. Process according to claim 5, further comprising impinging hot steam on the permeable press belt exerting the pressing force on the textile strip.

7. Process according to claim 5, further comprising changing the suction pressure to control the suction treatment.

* * * * *